United States Patent [19]

Blumle

[11] Patent Number: 4,526,501

[45] Date of Patent: Jul. 2, 1985

[54] SHEET PILE REPLENISHMENT APPARATUS

[75] Inventor: Martin Blumle, Gullesheim, Fed. Rep. of Germany

[73] Assignee: Winkler & Dunnebier Maschinenfabrik und Eisengiesserei GmbH & Co. Kg, Neuwied, Fed. Rep. of Germany

[21] Appl. No.: 579,454

[22] Filed: Feb. 13, 1984

[30] Foreign Application Priority Data

Feb. 25, 1983 [DE] Fed. Rep. of Germany ..... 3306575

[51] Int. Cl.[3] ..... B65H 29/34

[52] U.S. Cl. ..... 414/32; 271/3.1; 271/42; 271/268; 414/36; 414/82; 414/114; 414/123

[58] Field of Search ..... 414/32, 35, 36, 82, 414/112, 114, 117, 123; 271/3.1, 42, 189, 268

[56] References Cited

U.S. PATENT DOCUMENTS 2,940,617 6/1960 Reed ..... 414/114
3,206,042 9/1965 Peterson ..... 414/114
3,211,301 10/1965 Welhouse ..... 414/114
3,908,836 9/1975 Ikeda ..... 414/32

FOREIGN PATENT DOCUMENTS 54-25067 2/1979 Japan ..... 271/3.1

*Primary Examiner*—Leslie J. Paperner
*Attorney, Agent, or Firm*—Collard, Roe & Galgano

[57] ABSTRACT

There is provided a sheet pile replenishment apparatus in the form of a combined unstacking and restacking device for lifting a sub-pile of sheets from a supply pile of sheets, conveying and depositing the sub-pile on a pile of sheets on a feed pile plate of a sheet feeder of a processing machine, such as an envelope or bag machine. The apparatus includes a separating roller, disposed at an adjustable angle, which separates the sub-pile from the supply pile of sheets, a clamp for engaging the sub-pile, a table of comb-like construction for conveying the sub-pile, vibrating aligning pins for exactly aligning the sub-pile, and means for depositing the sub-pile in an exact position on the pile of sheets ready for feeding by the sheet feeder to the processing machine.

6 Claims, 5 Drawing Figures

SHEET PILE REPLENISHMENT APPARATUS

The present invention relates to a sheet pile replenishment apparatus in the form of a combined unstacking and restacking device which lifts a sub-pile of sheets from a supply pile of sheets, conveys and then deposits the sub-pile on a pile of sheets ready for feeding to a processing machine, such as an envelope or bag machine. More particularly, the present invention relates to such an apparatus which includes a table adapted to receive the sub-pile which is mounted on a carriage for horizontal iprocation between unstacking and restacking positions, a drivable separating roller provided at the table unstacking edge which is adapted to be introduced into the supply sheet pile, and at least one clamp comprising two vertically superposed jaws for retaining one edge of the lifted sub-pile during the unstacking and conveying operation, the clamp being disposed above the table so as to be horizontally and vertically movable with respect to the table.

For optimum operation of the sheet feeder of an envelope or bag machine, the sheet pile on the pile plate of the feeder must not exceed a given height. This requires replacement of the sub-piles of sheets on the pile plate. To eliminate a hand operation of this sort, which is time-consuming and expensive, pile replacement units are used which supply sheets to the feeders from large sheet piles resting on pallets.

It is known to use pile replacement or replenishment units which operate with an inverted feeder fed from below. In this case, the large sheet pile is brought up to the feed roller of the replacement unit from below and this operation is continued so that the top-most sheet of the pile always engages the feed roller. In this unit, the sheets are engaged individually, conveyed by means of rollers, passed in a staggered arrangement to conveyor belts, then extracted and fed to the sheet feeder of the processing machine.

The disadvantage of a unit of this kind is the unfavorably arranged feeder which has to be fed from below and which engages the sheets individually so that the rate of production of the processing machine is limited to this feed rate. Also, conveying the sheets in a staggered arrangement by belts followed by extraction of the sheets, means that the individual sheets are not accurately aligned and positioned when they reach the processing machine.

It is a primary object of the present invention to eliminate hand replacement or replenishment of sheet piles for sheet-fed high-speed processing machines and provide an apparatus for doing so reliably and accurately in order to fully utilize the production capacity of such machines. The object of the present invention, therefore, is to provide an apparatus which separates a sub-pile of determinable quantity from a large sheet pile on a pallet, conveys the sub-pile to the processing machine feeder where the sub-pile is deposited on the pile plate in an accurately aligned position. At the same time, control means are intended to maintain the pile on the feed pile plate at an optimum working height.

The above object, as well as others which will hereinafter become apparent, is accomplished in accordance with the present invention, by a sheet pile replenishment apparatus which comprises a table adapted to receive said sub-pile, said table being of comb-like construction wherein all the teeth thereof and hence the gaps therebetween are adjustable with respect to width, except that the middle pair of teeth are fixed defining a fixed gap therebetween; a carriage on which said table is mounted which horizontally reciprocates said table between said unstacking and restacking stations, said carriage also being adapted to raise and lower said table; a drivable separating roller provided at said table unstacking edge adapted to be introduced into said supply pile of sheets, said separating roller being adjustable on the unstacking side of said table at an angle relative to said supply pile of sheets so as to effectively extend or reduce the length of said table on the unstacking side according to the inclination of said separating roller; at least one clamp having two vertically superposed jaws for retaining the sub-pile during unstacking and conveying, said clamp being disposed above said table and adapted to be horizontally and vertically movable with respect thereto, the bottom jaw of said clamp adapted to be received in said fixed gap defined by the middle pair of fixed teeth of said table; aligning pins associated with said table for accurate alignment and positioning of said sub-pile, said aligning pins being adjustable with respect to their spacing and in the direction of conveyance of said sub-pile, adapted to be raised and lowered in the direction of the height of said sub-pile, and including centering means; and pile holders on said feed pile plate which include centering means engageable with the centering means of said aligning pins during restacking.

In order to release the bond between the sheets in the sub-pile and lift the same, the clamp engaging the sub-pile during the separating and conveying operations is inserted at the front of the sub-pile and acts as a means of leafing through the same. A controllable vibratory drive is also provided on the aligning pins or on the table for rapid and accurate alignment of the sub-pile.

The main advantages of the invention are that the sub-pile separated from the sheet supply pile is conveyed without any inaccuracy during transfer, because the pile replenishment unit operates with just one table. In addition, the aligning pins together with the vibratory drive accurately align the sub-pile and the centering of the aligning pins on the pile holders of the feed pile plate allows an accurately positioned transfer to the feed sheet pile. Another advantage is that the sub-pile clamp used as a leafing means breaks the bond between the sub-pile sheets and lifts the same. Another advantageous feature is the control means which so controls the unit delivery that the feed sheet pile is always at optimum working height.

The present invention will be described and understood more readily when considered together with the accompanying drawings, in which.

Figure 1:
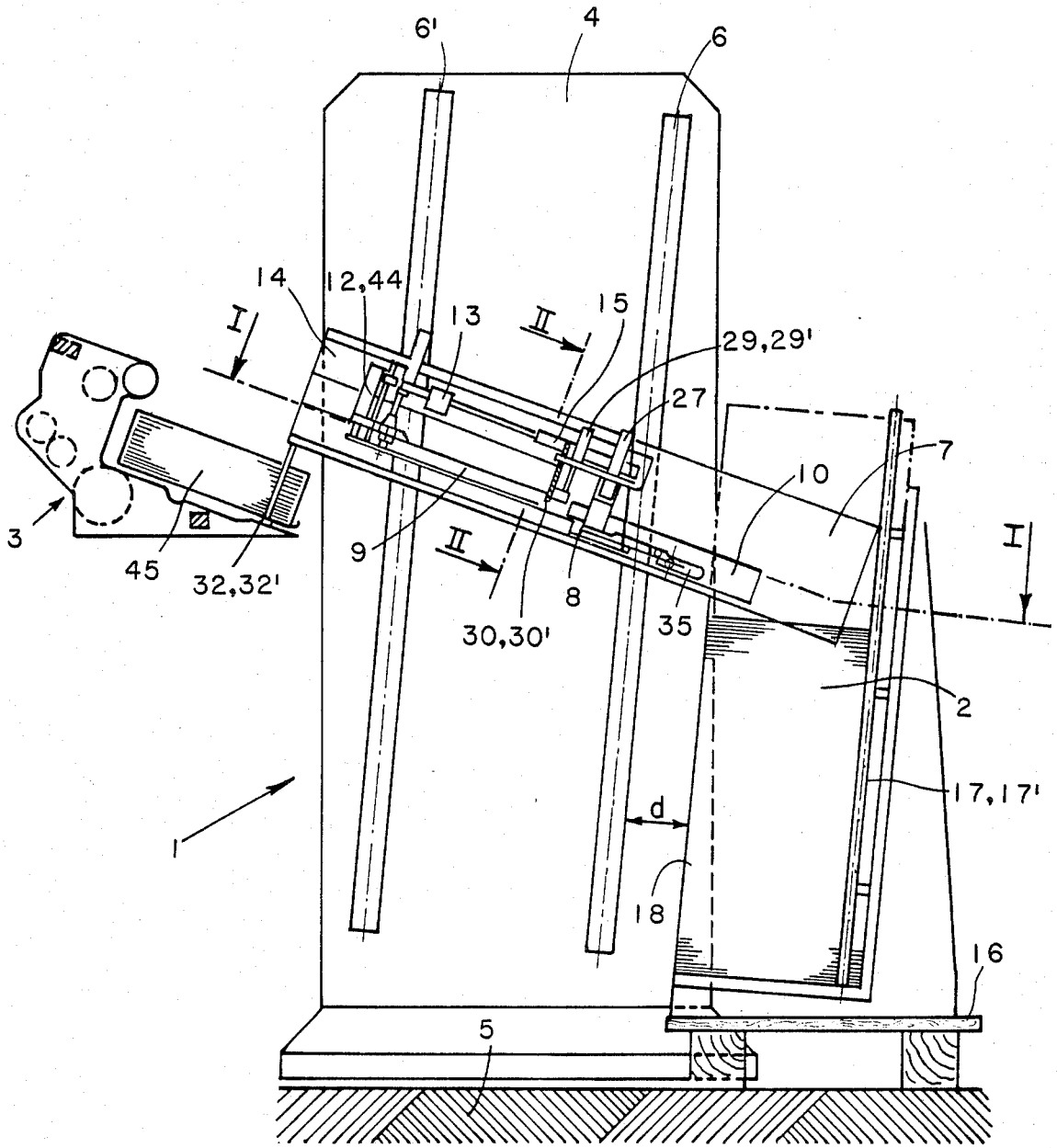
FIG. 1 is a side elevational view of the pile replenishment apparatus according to the present invention together with the sheet supply pile and the sheet feeder.
Figure 2:
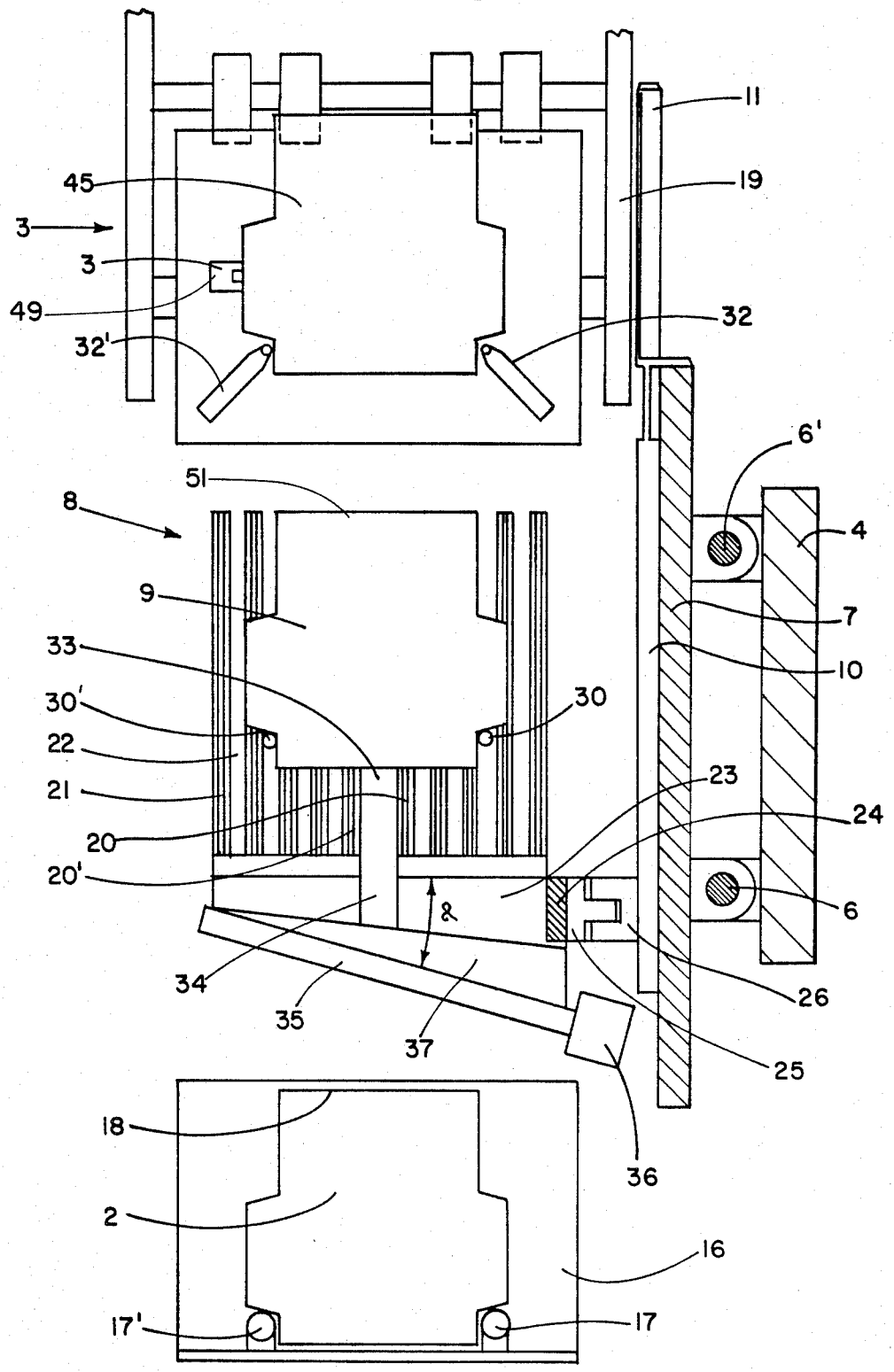
FIG. 2 is a cross-sectional view through the pile replenishment apparatus of FIG. 1 taken along the line I—I of FIG. 1.

Now turning to the drawings, the pile replenishment apparatus, designated 1, is illustrated in FIGS. 1 and 2 and is situated between the supply sheet pile 2 and the sheet feeder 3 of the processing machine.

As clearly seen in FIGS. 1 and 2, pile replenishment apparatus 1 includes an upright support 4 having a base plate 5 mounted on the floor, and a carriage 7 mounted for movement on parallel guides 6 and 6' on upright 4. Hydraulic drive means (not shown) are provided for the movement of carriage 7. A table 8 for conveying a sub-pile of sheets 9 is mounted for movement in the direction of conveyance of said sub-pile 9 on carriage 7 by means of guide 10 and drive 11. The top surface of table 8 is aligned parallel to pile plate 19 of sheet feeder 3.

Figure 3:
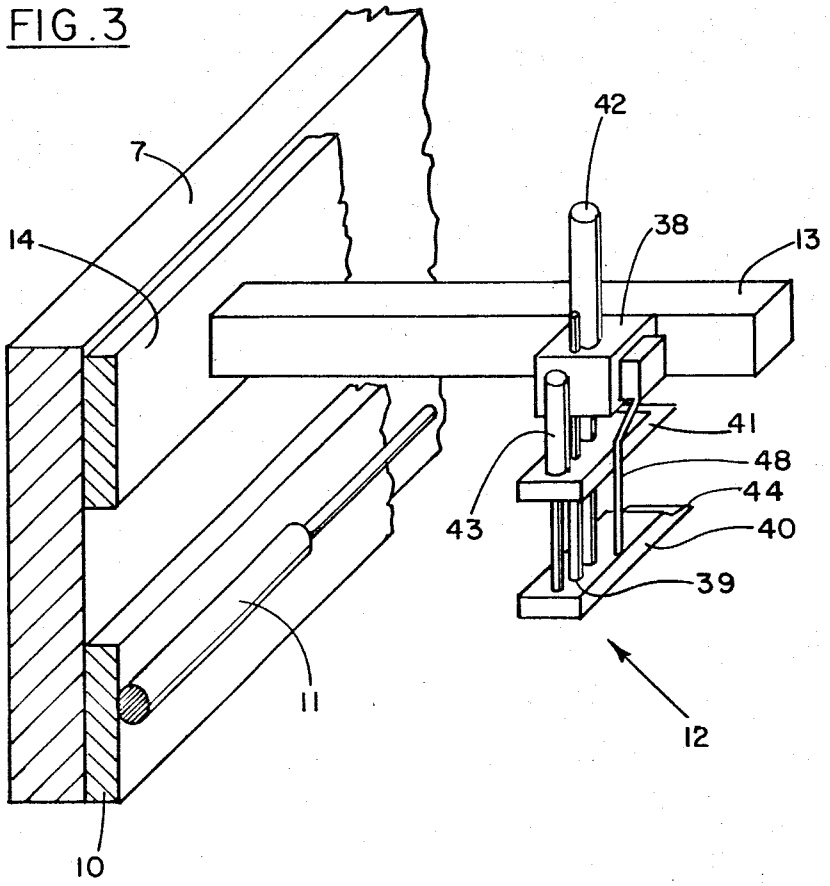
FIG. 3 is a perspective view of the clamp utilized in the apparatus according to the present invention.

Above table 8, a clamp 12 is mounted on carriage 7 for movement parallel to table 8 by means of a clamp holder 13 and guide 14 (see FIG. 3). The drive for this movement being provided by hydraulic cylinder 15. Sheet pile 2, as clearly seen in FIG. 1, is supported on a pallet 16 on the right next to table 8 and is so aligned by pile holder brackets 17 and 17' that its front edge 18 is parallel to guide 6 and is at a predetermined distance d therefrom.

Figure 4:
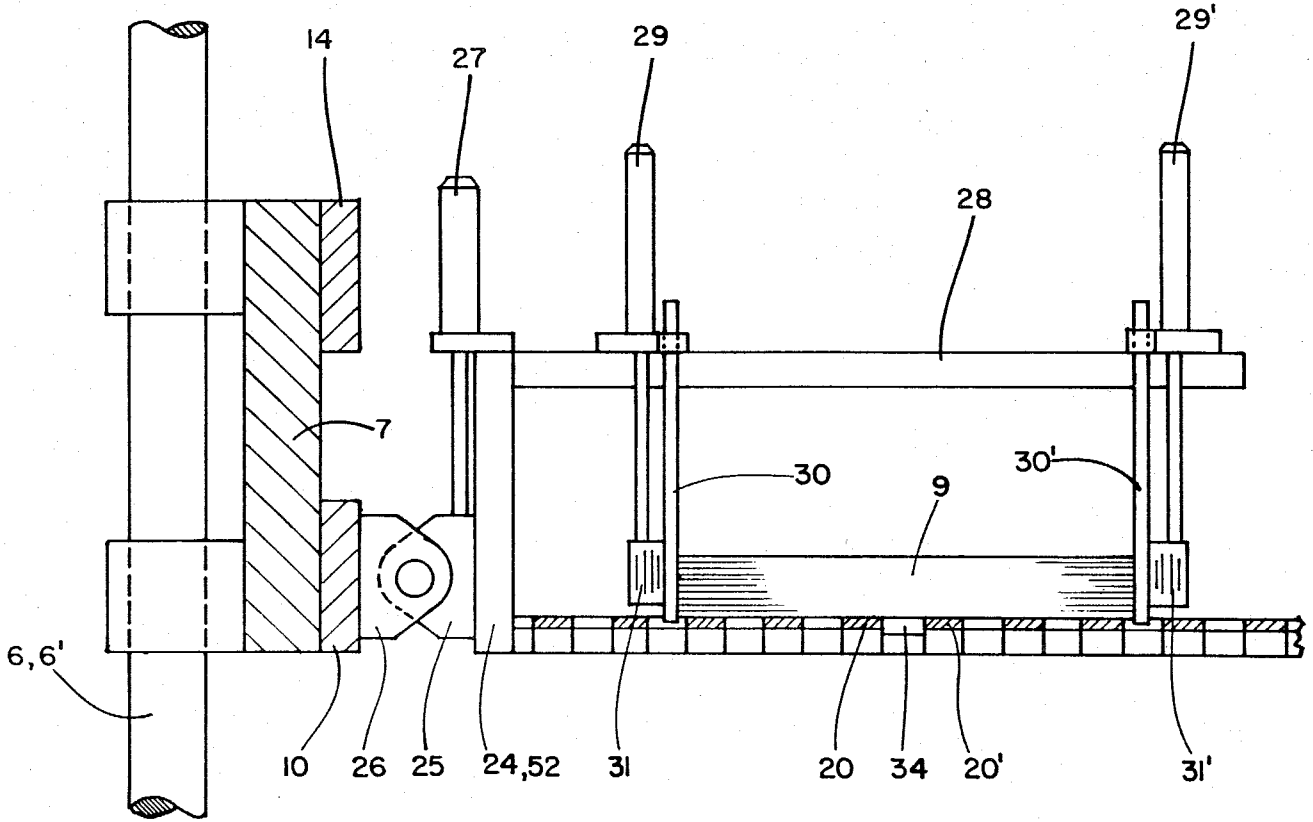
FIG. 4 is a cross-sectional view through the apparatus of FIG. 1 taken along the line II—II of FIG. 1.

As clearly seen in FIGS. 2 and 4, table 8 is in the form of a comb on the side facing sheet feeder 3. The comb teeth 21, and hence the resulting gaps 22, are adjustable in respect of width. Two middle teeth, designated 20 and 20', however, are fixed as is the gap 33 therebetween. In the direction of sheet pile 2, gap 33 is continued in the support 23 of table 8 in the form of a groove 34 of the same width, as seen in FIG. 4. A separating roller, designated 35, together with its drive 36 is disposed for adjustment of its angle of attack at the unstacking edge of table 8 for introduction into sheet pile 2. A segment plate 37 is secured to the separating roller 35 and partly rests on support 23. Segment plate 37 so moves on the latter, that upon adjustment of angle there is no gap between table 8 and roller 35. Adjustment of this angle has the effect of extending or reducing the length of table 8 by means of segment plate 37.

As seen in FIGS. 2 and 4, table 8 is so mounted on carriage 7 by means of support 23, member 24, guide 25 together with joint 26 and guide 10 that it can be pivoted upwards and downwards by means of joint 26. For restacking sub-pile 9 on pile 45 of sheets ready for feeding, table 8 is mounted for movement on guide 25 perpendicularly to the table surface and parallel to the pile holders 32 and 32', by means of drive 27 secured to member 24.

Member 28 is secured to member 24 so as to be parallel to table 8. Alignment pins 30 and 30' are disposed in the area above the table on member 28 and are adapted to be raised and lowered by drives 29 and 29' according to the height of sub-pile 9. The alignment pins are in adjustable spaced relationship to one another and also adjustable in the direction of conveyance. Vibratory drives 31 and 31' are secured directly to table 8 or pins 30 and 30' for the purpose of aligning sub-pile 9 prior to restacking.

FIG. 3 is a perspective view of clamp 12 which is provided on clamp holder 13. Secured to the latter is a block 38 in which rod 39 is guided for vertical movement and bears at its bottom end a bottom clamp jaw 40 which tapers in the forward direction to form a tip 44 for leafing through the sheets. The width of clamp jaw 40 is such that it can enter the gap 33 and the groove 34 of table 8 (see FIG. 2). Lower clamp jaw 40 is adapted to be raised and lowered with respect to block 38 by means of hydraulic cylinder 42. A top clamp jaw 41 is guided for vertical movement on rod 39 and the piston rod of hydraulic cylinder 42 and is adapted to be raised and lowered with respect to the bottom jaw 40 by means of the hydraulic cylinder 43. A sensor 48 is secured to block 38 and senses the front edge 51 of the separated sub-pile 9.

Figure 5:
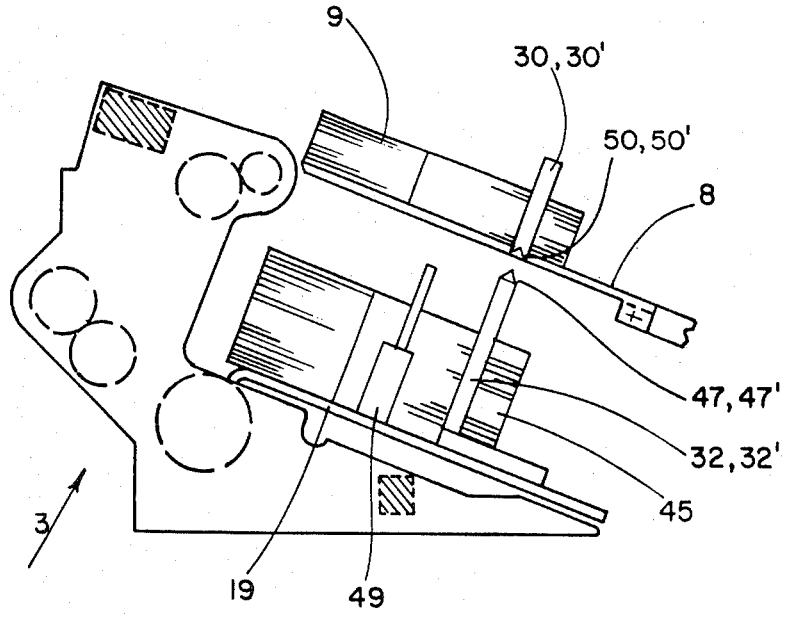
FIG. 5 shows a sheet feeder and a portion of the apparatus according to the present invention prior to the re-stacking operation.

FIG. 5 illustrates sub-pile 9 aligned by the aligning pins 30 and 30' and resting on the comb side of the table 8 just before it is re-stacked on pile 45 of sheets in the sheet feeder, the latter pile being held in the correct position by pile holders 32 and 32'. Aligning pins 30 and 30' have internal centering means 50 and 50' at the bottom thereof, by means of which they positively engage the outer centering means 47 and 47' of pile holders 32 and 32'. Sensor 49, which is adjustably secured to pile plate 19, senses the height of pile 45 of sheets ready for feeding and initiates a working cycle of the pile replenishing apparatus 1 as required so as to maintain pile 45 at an optimum working height.

In the operation of pile replenishment apparatus 1, at the starting position, table 8 is situated above pile 45 of sheets ready for feeding, clamp 12 is in the middle position between sheet pile 2 and sheet feeder 3 and aligning pins 30 and 30' are retracted to the back corners of sub-pile 9. Table 8 with sub-pile 9 then descends by means of drive 27 and guide 25 parallel to pile holders 32 and 32' of feeder 3 until aligning pins 30 and 30' engage the pile holders 32 and 32' and stop. Vibratory drives 31 and 31' are switched off and not operating at this time. Table 8 continues descending as aligning pins 30 and 30' rise to their top position. Upon reaching pile 45, table 8 withdraws from pile 45 and sub-pile 9 is deposited in exact alignment on pile 45. Table 8 then rises by means of drive 27 and guide 25 and moves along guide 10 into the middle position between pile 2 and sheet feeder 3, as in FIGS. 1 and 2. Table 8 continues to move along guide 10 to its front position at sheet pile 2 and at the same time moves to the withdrawal thickness of sub-pile 9 along guides 6 and 6'. Clamp 12 moves downwardly until its bottom jaw 40 has completely entered gap 33 and it is then moved by means of hydraulic cylinder 15 to pass through groove 34 into its front position immediately behind segment plate 37 of separating roller 35. Separating roller 35 begins to rotate and, by means of guide 10, table 8 and separating roller 35 move slowly into sheet pile 2 and are then raised a short distance along guides 6 and 6'. Separating roller 35 stops and clamp 12 engages sub-pile 9 and stops. Table 8 moves along guide 10 into sheet pile 2 until separating roller 35 is just in front of pile holder brackets 17 and 17', and is lifted a short distance along guides 6 and 6'. Clamp 12 engages sub-pile 9 and moves back along guide 14 by means of hydraulic cylinder 15 and draws sub-pile 9 in the rearward direction until the front edge 51 of sub-pile 9 is flush with the edge of table 8 facing sheet feeder 3. Table 8 then moves along guides 6 and 6' into the top depositing position, alignment pins 30 and 30' are lowered into the rear corners of sub-pile 9. Clamp 12 opens at this time, and vibratory drives 31 and 31' start. Clamp 12 is withdrawn along guide 14 until its tip 44 is situated beneath the front edge 51 of sub-pile 9. At this point clamp 12 rises along guide 39 and leafs through pile 9 by means of tip 44 moving in the upward direction. Then, clamp 12 moves along guide 14 into its middle position between sheet pile 2 and sheet feeder 3 and table 8 moves along guide 10 into its end or start position above sheet feeder pile 45.

If the pile replenishment apparatus 1 is not to be in use when small quantities of sheets are being processed, table 8 can be swung up at joint 26 so that sheet feeder 3 is more readily accessible to the operator.

It is understood that the foregoing general and detailed descriptions are explanatory of the present invention and are not to be interpreted as restrictive of the scope of the following claims.

What is claimed is:

1. A pile replenishment apparatus for lifting a sub-pile of sheets from a supply pile of sheets at an unstacking station, conveying and then depositing the sub-pile at a restacking station on a pile of sheets on a feed pile plate of a sheet feeder of a processing machine, such as an envelope or bag machine, said apparatus comprising:

(a) a table adapted to receive said sub-pile, said table being of comb-like construction wherein all the teeth thereof and hence the gaps therebetween are adjustable with respect to width, except that the middle pair of teeth are fixed defining a fixed gap therebetween;

(b) a carriage on which said table is mounted which horizontally reciprocates said table between said unstacking and restacking stations, said carriage also being adapted to raise and lower said table;

(c) a drivable separating roller provided at said table unstacking edge adapted to be introduced into said supply pile of sheets, said separating roller being adjustable on the unstacking side of said table at an angle relative to said supply pile of sheets so as to effectively extend or reduce the length of said table on the unstacking side according to the inclination of said separating roller;

(d) at least one clamp having two vertically superposed jaws for retaining the sub-pile during unstacking and conveying, said clamp being disposed above said table and adapted to be horizontally and vertically movable with respect thereto, the bottom jaw of said clamp adapted to be received in said fixed gap defined by the middle pair of fixed teeth of said table;

(e) aligning pins associated with said table for accurate alignment and positioning of said sub-pile, said aligning pins being adjustable with respect to their spacing and in the direction of conveyance of said sub-pile, adapted to be raised and lowered in the direction of the height of said sub-pile, and including centering means; and (f) pile holders on said feed pile plate which include centering means engageable with the centering means of said aligning pins during restacking.

2. The apparatus according to claim 1, wherein the bottom jaw of said clamp which engages the sub-pile during unstacking and conveying tapers to a tip which is adapted to be introduced at the front of the sub-pile as a means of leafing therethrough.

3. The apparatus according to claim 1, which includes control means for controlling the operation of the apparatus so that the pile of sheets on the feed pile plate is always at an optimum working height.

4. The apparatus according to claim 1, which further includes controllable vibratory drives mounted on said aligning pins for accurately aligning said sub-pile of sheets.

5. The apparatus according to claim 1, which further includes a controllable vibratory drive mounted on said table for accurately aligning said sub-pile of sheets.

6. The apparatus according to claim 1, wherein said table is pivotally mounted so that it can be pivotally moved out of operation.

* * * * *